US007127207B2

(12) United States Patent
Tsurusaki

(10) Patent No.: US 7,127,207 B2
(45) Date of Patent: Oct. 24, 2006

(54) IMAGE FORMING APPARATUS FEATURING UPWARD AND DOWNWARD TONER CARRYING PATHS

(75) Inventor: Teruaki Tsurusaki, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 103 days.

(21) Appl. No.: 10/900,338

(22) Filed: Jul. 28, 2004

(65) Prior Publication Data

US 2005/0058475 A1 Mar. 17, 2005

(30) Foreign Application Priority Data

Jul. 30, 2003 (JP) ..... 2003-282815

(51) Int. Cl.
*G03G 21/10* (2006.01)

(52) U.S. Cl. ..... 399/359

(58) Field of Classification Search ..... 399/99, 399/358, 359, 360

See application file for complete search history.

(56) References Cited

U.S. PATENT DOCUMENTS 4,894,688 A * 1/1990 Taniguchi et al. ..... 399/359
5,036,369 A * 7/1991 Toda et al. ..... 399/359
5,130,756 A * 7/1992 Taniyama ..... 399/358
RE35,528 E * 6/1997 Matsuura et al. ..... 399/358
5,742,882 A * 4/1998 Lee ..... 399/359 X
5,781,841 A 7/1998 Kouroku et al. ..... 399/360
6,366,755 B1 * 4/2002 Takashima ..... 399/359 X

FOREIGN PATENT DOCUMENTS

JP 4-116869 10/1992
JP 8-54808 2/1996
JP 9-281866 10/1997

* cited by examiner

*Primary Examiner*—Sandra L. Brase
(74) *Attorney, Agent, or Firm*—Fitzpatrick, Cella, Harper & Scinto

(57) ABSTRACT

An image forming apparatus, in which carrying paths for carrying the toner discharged from image forming portion are mutally connected, is capable of stable operation with satisfactory toner carrying at the connecting portion and not causing toner clogging. Preferably the image forming apparatus is low in cost and capable of smooth toner carrying even in case a toner carrying direction is an upward carrying direction. The image forming apparatus includes a plurality of toner carrying paths incorporating toner carrying screws, wherein an aperture is formed on a lateral face of each of the carrying paths, and, an aperture of an upstream carrying path and an aperture of a downstream carrying path are mutually opposed to connect the plurality of carrying paths. An angle formed by a toner carrying direction of the downstream toner carrying path and a gravitationally downward direction is larger than that in the upstream toner carrying path, and a carrying amount per unit time of the toner carrying screw of the downstream toner carrying path is made to be larger than a conveying amount per unit of the carrying screw in the upstream toner carrying path.

9 Claims, 14 Drawing Sheets

1
3
3a
2b
8a
2c
C
7
14
18
9
8b
B
4e
13
29
5
4d
5
4c
5
A
4b
2a
5
4a
18
106
DISPLAY
105
101
100
POWER SOURCE CIRCUIT
CONTROL CIRCUIT
AM
STOP DEVICE
103
102
104

IMAGE FORMING APPARATUS FEATURING UPWARD AND DOWNWARD TONER CARRYING PATHS

BACKGROUND OF THE INVENTION

1. Field of the Invention

The present invention relates to an image forming apparatus such as a copying apparatus of a recording apparatus of an electrophotographic process, adapted for use of a waste toner carrying apparatus which carries a waste toner, discharged from an image forming mechanism, to a recovery portion.

2. Related Background Art

In an image forming apparatus for example of an electrophotographic method of transfer type, a waste toner, which is not transferred from a photosensitive member to a recording material or an intermediate transfer belt but is discharged, remains in a cleaning device for the photosensitive member, though it is not illustrated.

For disposing of the waste toner accumulating in the cleaning device, various means and configurations are conceived as follows:

1) In case the image forming apparatus has a detachable process cartridge which including a developing device and a cleaning device, the waste toner may be stored in the cleaning device, by designing in advance a volume for containing the waste toner in the cleaning device so as to match the total amount of the waste toner generated until the process cartridge reaches an end of the service life thereof.

The process cartridge is considered to reach the end of its service life when toner of a predetermined amount, filled in advance in a developing toner hopper associated with the developing deice, is exhausted and is replaced by a new process cartridge.

2) Also in a process cartridge, Japanese Patent Application Laid-open No. 09-281866 proposes a configuration of providing a waste toner containing portion in the developing toner hopper in which a vacant space is progressively generated with the consumption of the toner, and feeding the waste toner in the cleaning device into the waste toner containing portion in the developing toner hopper, thereby decreasing the waste toner containing volume in the cleaning device and reducing the entire dimension of the process cartridge.

In such configuration, for feeding the waste toner from the cleaning device to the waste toner containing portion in the developing toner hopper, a waste toner outlet of the cleaning device and a waste toner containing portion in the developing toner hopper are connected, as shown in FIGS. 15A and 15B, by a curved tube 41 incorporating a flexible screw 40 which is formed by a spiral portion only without an axis, thereby forming an upward waste toner carrying path from the cleaning device to the waste toner containing portion in the developing toner hopper. A waste toner inlet 42 is formed in the curved tube 42 at a lateral end of the cleaning device, and the waste toner discharged from the waste toner outlet of the cleaning device drops and is charged into the curved tube 42 from the aforementioned waste toner inlet 42. The waste toner is carried and scooped up, by a rotation of the flexible screw 40, in the curved tube 41 toward the waste toner containing portion provided in the developing toner hopper.

3) Japanese Patent Application Laid-open No. 08-54808 proposes a configuration, in a photosensitive member or a process cartridge containing a photosensitive member, rendered detachable from a main body of the image forming apparatus, of utilizing an internal cavity of the photosensitive member as a waste toner container and feeding the waste toner from the cleaning device in succession into the internal cavity of the photosensitive member. More specifically, a waste toner outlet of the cleaning device and a rotary central axis of a cylindrical photosensitive member are connected with a curved tube incorporating a flexible screw, thereby forming an upward waste toner carrying path from the cleaning device to the internal cavity of the photosensitive member. Thus the waste toner is fed from the cleaning device to the internal cavity of the photosensitive member by a rotation of the flexible screw.

Also Japanese Patent Application Laid-open No. 04-116869 discloses a configuration of utilizing plural carrying tubes and carrying the waste toner upward to a waste toner container positioned above a joint portion of the carrying tubes.

Toner employed in an image forming apparatus for example of an electrophotographic process has a sufficient fluidity in a state before use, thus rarely forming agglomerates. Also the fluidity is stable and scarcely shows a difference resulting from a different in the environmental condition or in the lot. However, waste toner, that has once passed an image forming process, shows properties different from those of the toner before use, because of a decomposition of filler or a mixing of paper dust. More specifically, the fluidity decreases significantly, and a carrying property by carrying means such as a screw is also significantly lowered. It also forms agglomerates more easily, thus significantly increasing the frequency of solidifying in the carrying path, thereby locking the carrying means. Also as the waste toner is unstable in the composition for example by the mixing of paper dusts, the waste toner may fluctuates significantly in the fluidity and is very difficult to handle in the carrying means.

A waste toner carrying apparatus utilizing a flexible screw, as described in Japanese Patent Application Laid-open Nos. 09-281866 and 08-54808 allows forming a curved carrying path. However, in case the waste toner carrying path is bent excessively, or is relatively long with an upward carrying, or in case the amount of the carried waste toner is excessively large, the waste toner forms agglomerates in the carrying path because of the deteriorated carrying property of the waste toner, thereby increasing the frequency of locking the rotation of the flexible screw constituting the carrying means. Also, in case the external diameter of the flexible screw is made larger to increase the carrying capacity for the waste toner, the flexible screw loses flexibility and the carrying path inevitably results in a larger radius in the curvature thereof, thus hindering compact designing of the apparatus. Also, since the flexible screw carries the waste toner by rotation under friction with the internal wall of the tube or the pipe constituting the external wall, there results a concern for a loss of durability by abrasion in a contact portion between the flexible screw and the internal wall of the tube or the pipe. For obtaining a sufficient durability, which is the same as the service life of the apparatus, it is necessary to select a tube or a pipe resistant to abrasion, leading to a higher component cost.

Therefore, a process cartridge or an image forming apparatus disclosed in Japanese Patent Application Laid-open Nos. 09-281866 and 08-54808 realizes the configuration with the flexible screw, within limited conditions such as a suitable curvature of the carrying path, a suitable carrying path length, a suitable carrying amount of the waste toner, and a suitable durability.

However, in an image forming apparatus or a full-color image forming apparatus of toner replenishing type, it is required to stably carry the waste toner without clogging over a prolonged period despite of the deteriorated carrying property of such waste toner and also to stably carry a large amount of the waste toner, and, particularly in a full-color apparatus, the amount of the waste toner becomes very large because of the presence of four developing devices, and the aforementioned waste toner carrying apparatus utilizing the flexible screw is not adequate for collectively carrying all the waste toners upwards to a waste toner recovery container.

Therefore, in the image forming apparatus or the full-color image forming apparatus of a toner replenishing type, there is adopted a vertical layout configuration in which a waste toner recovery container is provided below a waste toner outlet of the developing device (vertical layout), whereby the waste toner discharged from the waste toner outlet of the cleaning device drops and is collected in the waste toner recovery container, or in which, even in case the waste toner discharged from the waste toner outlet of the cleaning device is carried to the waste toner recovery container by a waste toner carrying apparatus utilizing a hard carrying screw or a flexible screw, such carrying is executed through a downward carrying path, an inclined downward carrying path or a substantially horizontal linear carrying path.

However, in the full-color apparatus or a toner replenishing type, such vertical layout, in which the waste toner recovery container of a large capacity is positioned below the waste toner outlet of the cleaning device for recovering the discharge waste toner by dropping, is associated with a drawback of rendering the image forming apparatus itself bulky. Also in an image forming apparatus, it is required to limit the direction of access by the user or the service personnel for toner container replacement, process cartridge replacement, jam clearance or waste toner box replacement to only one direction in consideration of operability, and such direction is a front side of the image forming apparatus where the user is to be positioned.

In order to position the waste toner box at the front side of the image forming apparatus and to realize a compact configuration at the same time, it is necessary to adopt a layout in which the waste toner recovery container is positioned at the same height as the developing device etc., and for this purpose, there is required a waste toner carrying apparatus which is capable of carrying upwards the waste toner, discharged from a waste toner outlet of the cleaning device, to an upper aperture of a waste toner recovery container positioned at a same height as the developing device and also capable of continuing stable upward carrying without causing a clogging of the carrying path by the waste toner and without requiring a cleaning operation over a prolonged period extending to the lifetime of the main body of the image forming apparatus, and which is also compact and inexpensive.

Particularly in a full-color apparatus of a toner replenishing type, there is required compact and inexpensive waste toner carrying means capable of carrying the waste toners, discharged from four developing devices and a transfer belt cleaning device, collectively to a recovery container, also capable of continuing carrying without causing a clogging by the waste toner and without requiring a cleaning operation up to the lifetime of the main body of the image forming apparatus, and not requiring a drive source or a locking detection mechanism in plural units. Also in a full-color apparatus of toner replenishing type in which sheet paths are formed short in a vertical direction and four developing devices are positioned in an inclined arrangement, there is required a waste toner carrying apparatus in which a waste toner box is provided at the front side of the image forming apparatus thereby improving the replaceability of the waste toner box without an increase in the footprint of the apparatus.

However, in case of carrying the waste toner upwards by providing a screw in a carrying tube as described in Japanese Patent Application Laid-open No. 04-116869, the waste toner is difficult to carry at an upper connecting portion of the carrying tube because it is inclined upwards, and a mere connection of the carrying tubes results in a clogging of the toner at the connecting portion.

Also the toner transfer at the connecting portion of the carrying tubes is usually achieved by forming a connecting portion at a bottom face of the carrying tube and transferring the toner by the weight thereof to a downstream carrying tube, but, in case a connecting portion is formed at a side face of the carrying tube, the carrying power at such transfer portion becomes lower as the weight of the toner cannot be utilized for transfer to the carrying tube of the downstream side. On the other hand, an increase in the carrying power at such transfer portion may result in a toner clogging.

SUMMARY OF THE INVENTION

In consideration of the foregoing, an object of the present invention is to provide an image forming apparatus capable of stable carrying without clogging by a carried substance. Preferably there is provided an image forming apparatus capable of powder carrying without difficulty even in case that one of powder carrying directions is an upward carrying direction, at a reduced cost.

The present invention provides an image forming apparatus characterized by following configurations:

(1) An image forming apparatus including image forming means, plural carrying tubes for carrying toner discharged from the image forming means to a recovery portion and carrying means which is contained in the interior of the carrying tubes for carrying the toner in the carrying tubes, in which the carrying tubes are provided with apertures and an aperture of an upstream carrying tube is opposed to an aperture of a downstream carrying tube adjacent to the upstream carrying tube to achieve mutual communication of the carrying tubes, wherein, in case an angle formed by a toner carrying direction and a gravitationally downward direction is larger in the downstream carrying tube than in the upstream carrying tube, a carrying amount of the carrying means per unit time is made larger in the downstream carrying tube than in the upstream carrying tube.

(2) An image forming apparatus including image forming means, plural carrying tubes for carrying toner discharged from the image forming means to a recovery portion and carrying means which is contained in the interior of the carrying tubes for carrying the toner in the carrying tubes, in which the carrying tubes are provided with apertures and an aperture of an upstream carrying tube is opposed to an aperture of a downstream carrying tube adjacent to the upstream carrying tube to achieve mutual communication of the carrying tubes, wherein the apertures are provided substantially horizontally in lateral faces of end portions of the carrying tubes are mutually connected, and the carrying means in the carrying tube at an upstream side to the aperture has a carrying power which is decreased within a range of the aperture toward the upstream side thereof.

(3) An image forming apparatus including image forming means, plural carrying tubes for carrying toner discharged from the image forming means to a recovery portion and plural screws having spiral portions for carrying the toner in the carrying tubes, in which the carrying tubes are provided with apertures and an aperture of an upstream carrying tube is opposed to an aperture of a downstream carrying tube adjacent to the upstream carrying tube to achieve mutual communication of the carrying tubes, wherein at least one of the plural carrying tubes is connected by mutually opposed arrangement of apertures provided on a lateral face of the carrying tubes, carrying directions are substantially perpendicular at the aperture, and the spiral portion rotates, seen from the side of the aperture, in a forward direction to the carrying direction at the downstream side.

DETAILED DESCRIPTION OF THE PREFERRED EMBODIMENTS (Embodiment 1)

(1) Example of Image Forming Apparatus

Figure 1:
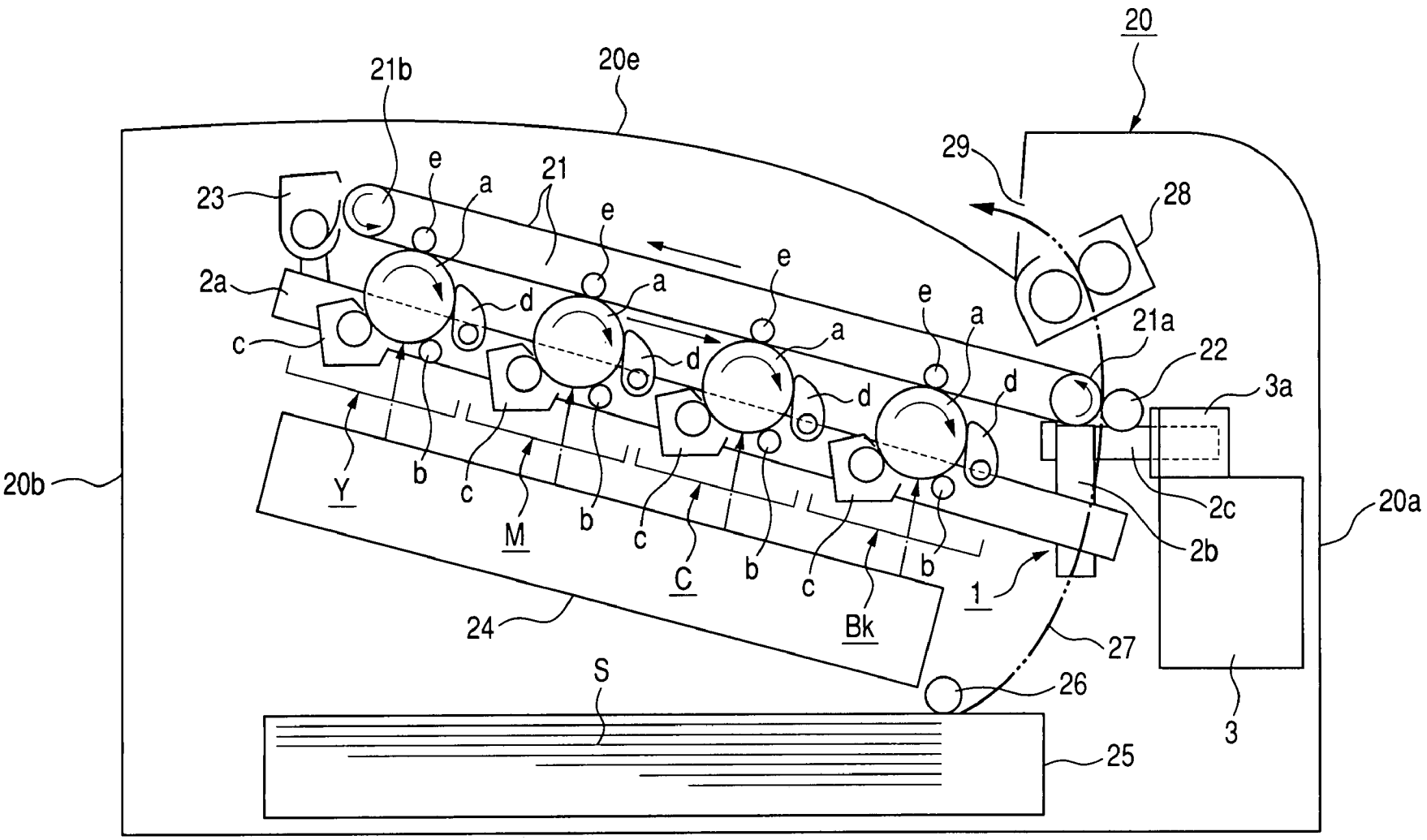
FIG. 1 is a lateral schematic view showing principal parts of an image forming mechanism of an image forming apparatus embodying the invention.
Figure 2:
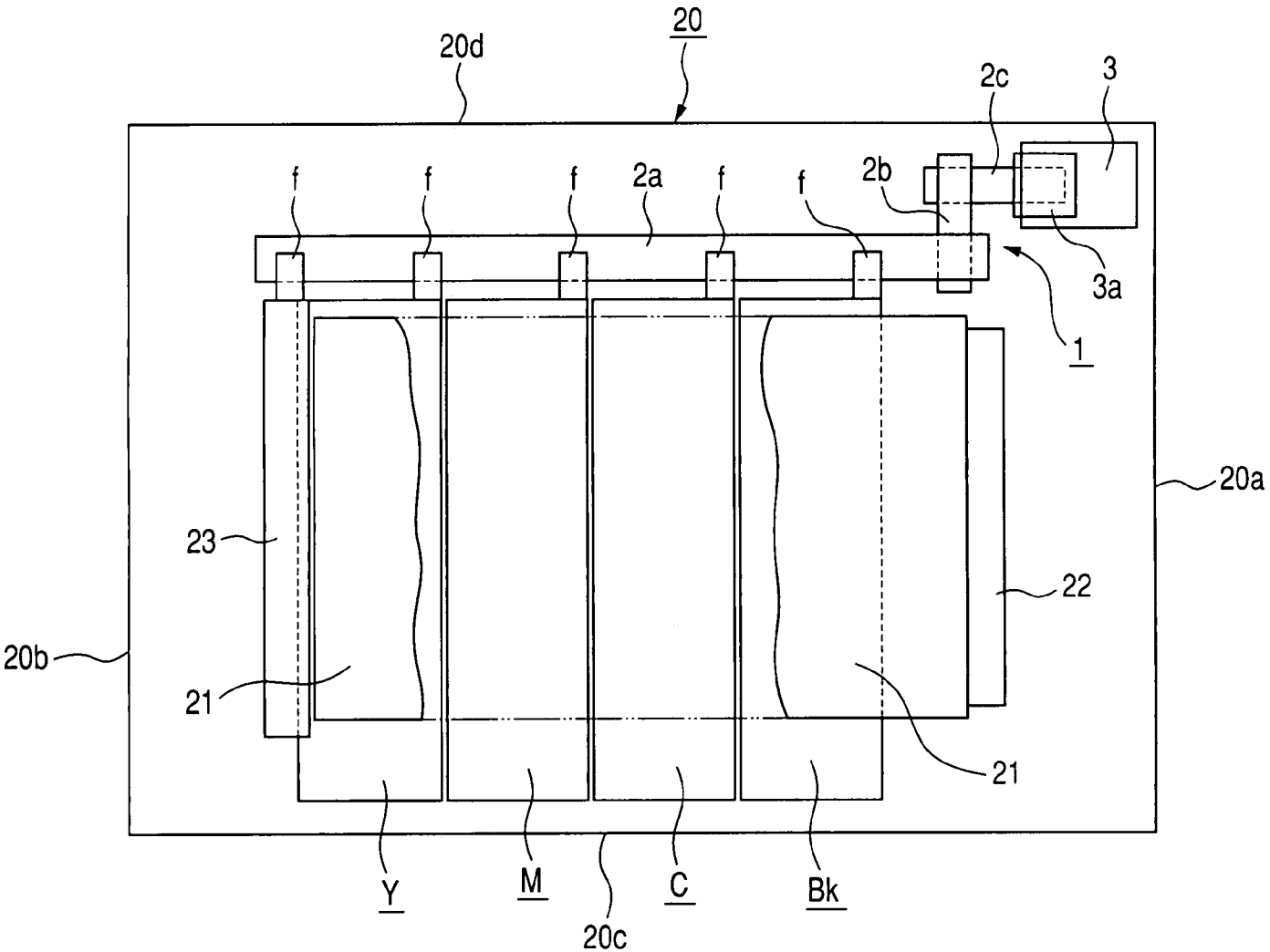
FIG. 2 is a schematic plan view showing principal parts of the image forming mechanism.

FIGS. 1 and 2 are schematic views showing the configuration of an image forming apparatus, in which a powder carrying apparatus of the present invention is applied as a waste toner carrying apparatus for carrying waste toner, discharged from an image forming mechanism, to a recovery portion.

The image forming apparatus of the present embodiment is a tandem-type color LBP (color laser beam printer) utilizing an electrophotographic process of transfer type. FIG. 1 is a lateral schematic view showing principal parts of an image forming mechanism, and FIG. 2 is a schematic plan view of the principal parts of the image forming mechanism.

Reference numeral 20 indicates an outer casing of the main body of the image forming apparatus, and reference numerals 20*a*, 20*b*, 20*c*, 20*d* and 20*e* respectively indicates a front plate, a rear plate, a left side plate, a right side plate and a upper plate of the casing 20.

First to fourth image forming units Y, M, C, Bk, for respectively forming toner images of a yellow component, a magenta component, a cyan component, and a black component of a full-color image, are arranged in succession (tandem arrangement) from the side of the rear plate 20*b* toward the side of the front plate 20*a* in the main body of the image forming apparatus. In the present embodiment, the first to fourth image forming units Y, M, C, Bk are successively lowered in the vertical position whereby the tandem arrangement of the first to fourth image forming units Y, M, C, Bk is made along an inclined plane lower at the front side. Each of the first to fourth image forming units Y, M, C, Bk is constituted of a drum-shaped electrophotographic photosensitive member a (hereinafter represented as photosensitive drum), rotated clockwise as indicated by an arrow with a predetermined peripheral speed (process speed), a charging roller b, a developing device c, a cleaning device "d" etc.

An endless intermediate transfer belt 21 is provided above and over the first to fourth image forming units Y, M, C, and Bk. The intermediate transfer belt 21 is supported between a drive roller 21*a* at the side of the front plate 20*a* and a turn roller 21*b* at the side of the rear plate 20*b*, and is driven, by the rotation of the drive roller 21*a*, counterclockwise as indicated by an arrow at a predetermined peripheral speed (process speed). A lower surface of a lower half belt portion of the intermediate transfer belt 21 is opposed to upper surfaces of the photosensitive drums "a" in the first to fourth image forming units Y, M, C, Bk, and the lower half belt portion of the intermediate transfer belt 21 is maintained in contact, by primary transfer rollers e provided inside the lower half belt portion, with the upper surfaces of the photosensitive drums "a", thereby forming a primary transfer nip between the upper surface of each photosensitive drum "a" and the lower surface of the lower half belt portion of the intermediate transfer belt 21.

A secondary transfer roller 22 is provided at the side of the drive roller 21*a* for the intermediate transfer belt 21 and is maintained in contact with the intermediate transfer belt 21 by pinching the same in cooperation with the drive roller

21*a*, thereby forming a secondary transfer nip between the secondary transfer roller 22 and the intermediate transfer belt 21.

A cleaning device (cleaner) 23 for the intermediate transfer belt 21 is provided at the side of the turn roller 21*b* for the intermediate transfer belt 21 and maintains a cleaning member in contact with the surface the intermediate transfer belt 21 by pinching the same in cooperation with the turn roller 21*b*.

In the first to fourth image forming units Y, M, C, Bk, the photosensitive drums "a" are rotated. These photosensitive drums "a" are rotated by a drum motor (DC servo motor) (not shown), but it is also possible to provide the photosensitive drums "a" with respectively independent drive sources. The rotary drive of the drum motor is controlled by a DSP (digital signal processor) (not shown), and other controls are executed by a CPU (not shown).

In the image forming units Y, M, C, Bk, each photosensitive drum "a" is charged uniformly, in the course of rotation thereof, at predetermined polarity and potential by a charging roller b, and thus charged surface is exposed to an optical image by a laser scanner 24 to form an electrostatic latent image corresponding to image information on the photosensitive drum "a". The electrostatic latent image is developed by a developing device c as a toner image, whereby toner images of yellow, magenta, cyan and black colors, which are color separated components of a full-color image, are formed by an electrophotographic process respectively on the surfaces of the photosensitive drums "a" of the image forming units Y, M, C, Bk, at a predetermined timing in sequence control.

Then the toner images of yellow, magenta, cyan and black colors, formed on the surfaces of the photosensitive drums "a" of the first to fourth image forming units Y, M, C, Bk at a predetermined sequence control timing are transferred onto the lower surface of the lower half belt portion of the intermediate transfer belt 21 in superposed manner under successive alignments at the primary transfer nips of the image forming units Y, M, C, Bk whereby an unfixed full-color toner image is synthesized on the surface of the intermediate transfer belt 21.

On the other hand, a recording material (transfer sheet) S in a sheet cassette 25 provided in a lower part of the main body of the image forming apparatus is separated and fed by a feeding roller 26 at a predetermined sequence control timing, then introduced into a sheet path 27 and is supplied to the secondary transfer nip under synchronization by registration rollers (not shown) provided in the sheet path 27. At the secondary transfer nip, the unfixed full-color toner image formed on the intermediate transfer belt 21 is collectively transferred onto the recording material S by the secondary transfer roller 22.

The recording material S, bearing the unfixed full-color toner image collectively transferred at the secondary transfer nip, is separated from the intermediate transfer belt 21, introduced into a fixing device 28 and is subjected therein to a heat fixing process of the toner image, whereupon it is discharged as a full-color image print from a discharge aperture 29 onto the upper plate 20*e* of the casing, serving as a discharge tray.

In the first to fourth image forming units Y, M, C, Bk, the surface of the photosensitive drum "a" after the transfer of the toner image at the primary transfer nip to the intermediate transfer belt 21 is subjected, by the respective cleaning device, to removal of residual substances such as transfer residual toner, and is then used again for image formation. Also the surface of the intermediate transfer belt 21 after the collective transfer of the unfixed full-color toner image at the secondary transfer nip to the recording material S is subjected, by a cleaning device 23, to removal of residual substances such as transfer residual toner, and is then used again for image formation.

In the first to fourth image forming units Y, M, C, Bk, the cleaning devices "d" for the photosensitive drums are for example of cleaning blade type, and the transfer residual toner scraped off by the cleaning blade from the surface of the photosensitive drum "a" is carried, by rotation of a toner carrying screw of a drill type provided in such cleaning device, in the cleaning device to an end portion at the side of the right plate 20*d* of the outer casing, then drops and is discharged from a waste toner outlet provided at such side of the cleaning device, through a downward toner discharge path "f", into a first carrying tube 2*a* of a waste toner carrying apparatus of the present invention.

Also the intermediate transfer belt cleaning device 23 is a cleaning blade type, and the transfer residual toner scraped off by the cleaning blade from the surface of the intermediate transfer belt 21 is carried, by rotation of a toner carrying screw of the drill type provided in such cleaning device, in the cleaning device to an end portion at the side of the right plate 20*d* of the outer casing, then drops and is discharged from a waste toner outlet provided at such side of the cleaning device, through a downward toner discharge path "f", into the first carrying tube 2*a* of the waste toner carrying apparatus of the present invention.

The waste toner, discharged from the cleaning devices "d" of the first to fourth image forming units Y, M, C, Bk and the intermediate transfer belt cleaning device 23 into the first carrying tube 2*a* of the waste toner carrying apparatus 1, is collectively carried in the first carrying tube 2*a*, a second carrying tube 2*b* and a third carrying tube 2*c* and is dropped and stored in a recovery container (waste toner box) 3 of a large capacity. The waste toner recovery container 3, when filled with the waste toner, is detached from the apparatus by opening a front plate 20*a*, formed as an open-closable door, and is replaced by an empty container.

The waste toner carrying apparatus 1 will be explained in detail in item (2).

In the image forming apparatus of the present embodiment, each of the first to fourth image forming units Y, M, C, Bk is constructed as a process cartridge which includes a photosensitive drum "a", a charging roller b, a developing device c, a cleaning device "d" etc., and which can be detached from and mounted on the main body of the image forming apparatus by opening a left side plate 20*c* of the outer casing, formed as an open-closable door. Also the developing device c in each process cartridge of the image forming units Y, M, C, Bk may be of a toner use-up type or a toner replenishing type. Naturally the first to fourth image forming units Y, M, C, Bk may also be constructed as an image forming apparatus without utilizing the configuration of process cartridge.

(2) Waste Toner Carrying Apparatus 1

Figure 3:
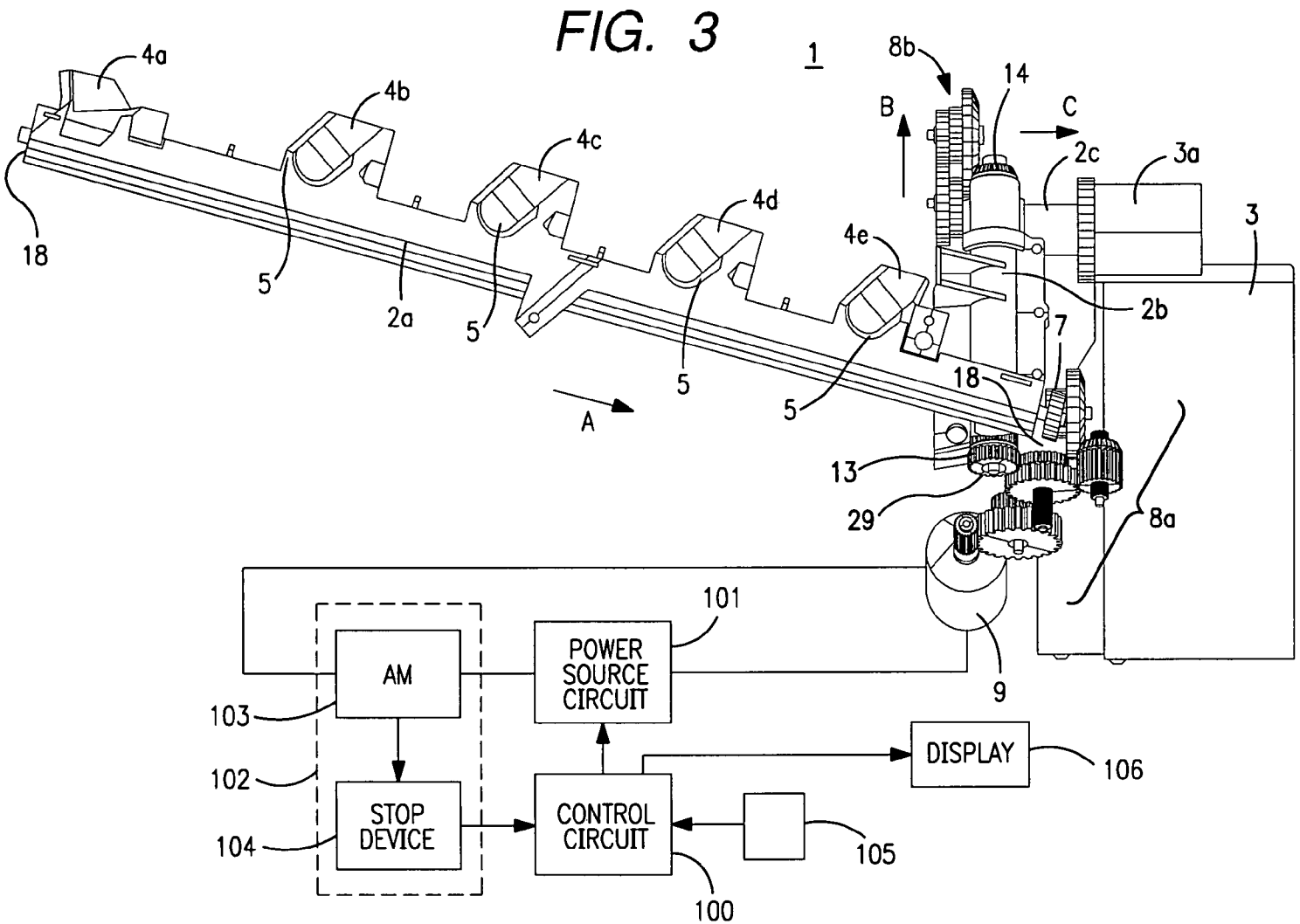
FIG. 3 is a schematic external perspective view of an entire waste toner conveying apparatus.

The waste toner carrying apparatus 1 is provided between the first to fourth image forming units Y, M, C, Bk and the right side plate 20*d* of the outer casing. FIG. 3 is a schematic external perspective view of the entire waste toner carrying apparatus 1. In the waste toner carrying apparatus 1, a carrying path is formed, as explained in the foregoing, by a first carrying tube 2*a* which receives the waste toner, discharged from the cleaning devices "d" of the first to fourth image forming units Y, M, C, Bk and the intermediate transfer belt cleaning device 23 and carries such waste toner collectively in a direction A, a second carrying tube 2*b* which receives the waste toner from the first carrying tube 2*a* and executes upward carrying in a direction B, and a third carrying tube 2*c* which receives the waste toner from the second carrying tube 2*b* and execute horizontal carrying in a direction C for charging the waste toner into a recovery container 3.

The first to third carrying tubes 2*a*, 2*b*, 2*c* are not integrally formed but are constructed separately, and each basically incorporates waste toner carrying means therein and is provided with an inlet aperture and an outlet aperture for the waste toner on a lateral face. In a portion where an upstream tube and a downstream are adjacent, the waste toner outlet aperture of the upstream carrying tube is opposed to the waste toner inlet aperture of the downstream carrying tube to achieve mutual communication of the carrying tubes, and the plural carrying tubes are connected in combination and are fixed in a frame or supporting plates in the main body of the image forming apparatus for example with screws, so as to construct a desired three-dimensional waste toner carrying path.

In the adjacent portion of the upstream and downstream tubes in the aforementioned configuration, the opposed communicating connection of the waste toner outlet aperture of the upstream carrying tube and the waste toner inlet aperture of the downstream carrying tube can be achieved by a direct contact of the aperture edges of the opposed apertures if the toner leak can be prevented without a sealing member. Also such opposed communicating connection can be achieved by opposing the apertures across a soft sealing material of a thickness of about 1 mm for preventing toner leak between the apertures.

1) First Carrying Tube 2*a*

The first carrying tube 2*a* is a straight tube member of a hard material incorporating carrying means therein, and is provided by fixing to a frame or a supporting plate in the main body of the image forming apparatus for example with screws, in a position between the first to fourth image forming units Y, M, C, Bk, the intermediate transfer belt cleaning device 23 and the right side plate 20*d* of the outer casing 20, over the entire range of the first to fourth image forming units Y, M, C, Bk and the intermediate transfer belt cleaning device 23, in such a position lower than the first to fourth image forming units Y, M, C, Bk and the intermediate transfer belt cleaning device 23 and in an inclined position lower in the front side, substantially matching the inclination angle of the tandem arrangement of the first to fourth image forming units Y, M, C, Bk.

As shown in FIG. 3, the first carrying tube 2*a* is provided, on an upper surface thereof and along the longitudinal direction thereof, with five waste toner inlet apertures 4*a*, 4*b*, 4*c*, 4*d*, 4*e* for receiving the waste toner discharged from the waste toner discharge apertures of the intermediate transfer belt cleaning device 23 and the cleaning devices "d" of the first to fourth image forming units Y, M, C, Bk.

The waste toner discharge aperture of the intermediate transfer belt cleaning device 23 and the waste toner discharge apertures of the cleaning devices "d" of the first to fourth image forming units Y, M, C, Bk communicate with the corresponding waste toner inlet apertures 4*a*, 4*b*, 4*c*, 4*d*, 4*e* of the first carrying tube 2*a* respectively through downward toner discharge paths "f" (FIG. 2), and the waste toner discharged from the waste toner discharge apertures of the intermediate transfer belt cleaning device 23 and the cleaning devices "d" of the first to fourth image forming units Y, M, C, Bk is dropped and guided by gravity into the interior of the second carrying tube 2*a* through the downward toner discharge paths "f" and the waste toner inlet apertures 4*a*, 4*b*, 4*c*, 4*d*, 4*e*. In the waste toner inlet apertures 4*a*, 4*b*, 4*c*, 4*d*, 4*e* of the first carrying tube 2*a*, a sealing material 5 such as of Moltopren (trade name) with a thickness of about 1 mm is adhered in order to prevent waste toner leakage from a connecting portion thereof with the downward toner discharge path "f".

Figure 4:
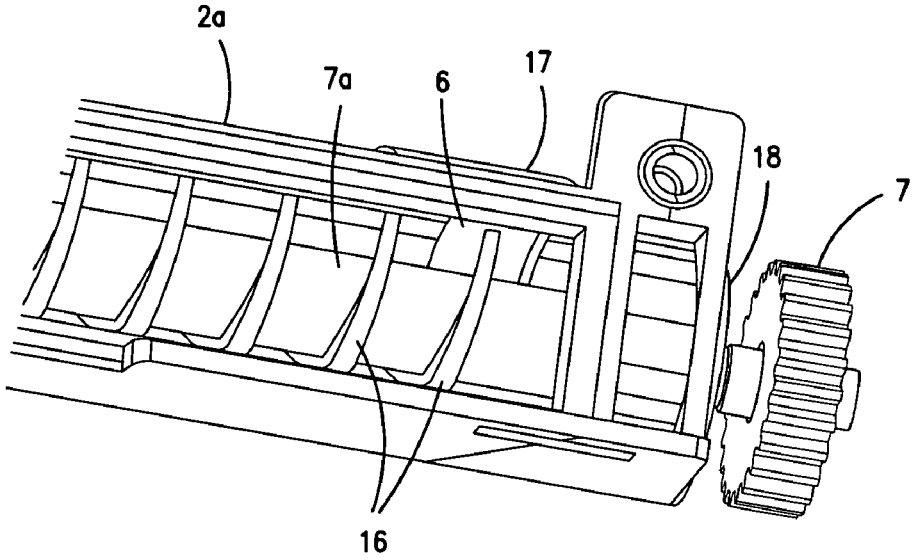
FIG. 4 is a partially cut-off perspective view of an aperture portion at a downstream end part of a first carrying tube in a waste toner carrying direction (aperture being provided on a lower or lateral face of the carrying tube)
Figure 5:
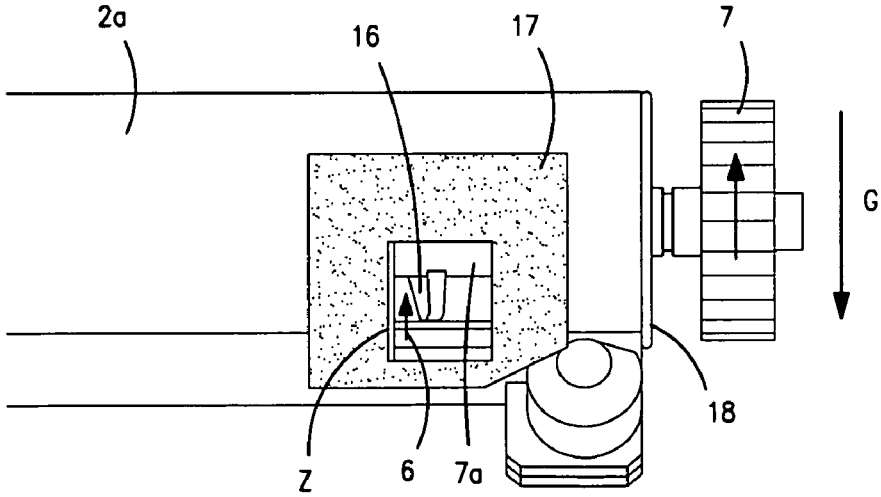
FIG. 5 is a schematic view of a downstream end part of the first carrying tube in a waste toner carrying direction (aperture being provided on a lower or lateral face of the carrying tube)

Inside the first carrying tube 2*a*, there is incorporated, as waste toner carrying means, a first carrying screw 7*a* (rotary member, carrying member) of a drill type having a spiral portion around a shaft, of which ends are rotatably supported between bearings 18 provided on both ends of the first carrying tube 2*a*, as shown in FIGS. 4 and 5. FIGS. 4 and 5 are a partially cut-off perspective view and a schematic view showing an aperture in case the first carrying tube is provided with an aperture at a downstream end portion in the waste toner carrying direction. The aperture is provided on a wall extending along the carrying direction of the first carrying tube, and is provided on a bottom face (lower face in the direction of gravity) or in a lateral face, in the cross-sectional circumference of the carrying tube.

Figure 6:
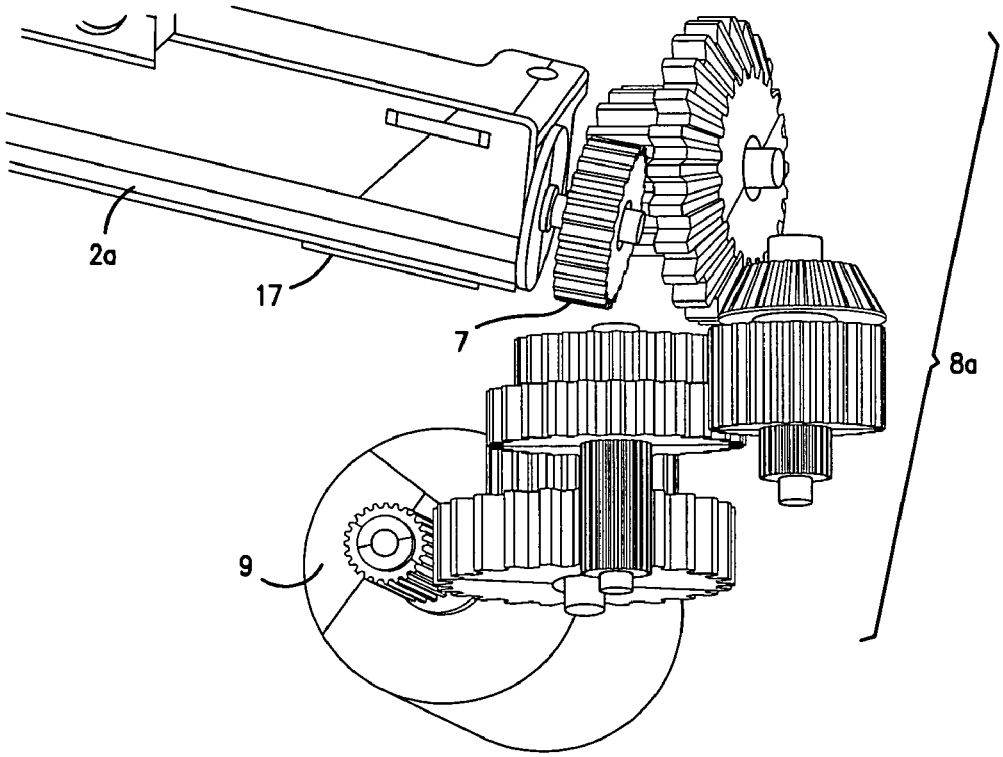
FIG. 6 is a perspective view of a first drive gear train.

In case the aperture is formed on a lateral face (left or right to the carrying direction) as shown in FIG. 5, a direction of gravity is indicated by an arrow G, and a gear 7 rotates clockwise as indicated by an arrow, when seen from a downstream end. Therefore, at the toner outlet aperture of the first carrying tube 2*a*, the spiral portion 16 of the carrying screw 7*a* rotates in a direction (indicated by an arrow Z) from a lower side to an upper side in the direction of gravity. This is a forward rotation relative to the carrying direction in the second carrying tube at the downstream side of the aperture, thereby achieving smooth toner transfer at the aperture. The shaft of the first carrying screw 7*a* protrudes, at the downstream side of the waste toner carrying direction, from the bearing 18 and bears a gear 7, to which a driving power of a motor 9 is transmitted through a first drive gear train 8*a*, constituted of plural gears, as shown in FIGS. 3 and 6, thereby rotating the first carrying screw 7*a*. The motor 9 and the first drive gear train 8*a* are fixedly supported on a supporting plate or a frame of the main body of the image forming apparatus for example with screws.

A clearance between the external radial end of the carrying screw 7*a* and the internal wall of the carrying tube 2*a* is maintained minimum within an extent that the carrying screw 7*a* does not touch the internal wall of the carrying tube 2*a*. At the internal side of the bearing 18, there is also provided a sealing material (not shown) such as of Moltopren, in order to prevent leakage of the waste toner from the bearing portion.

Figure 9:
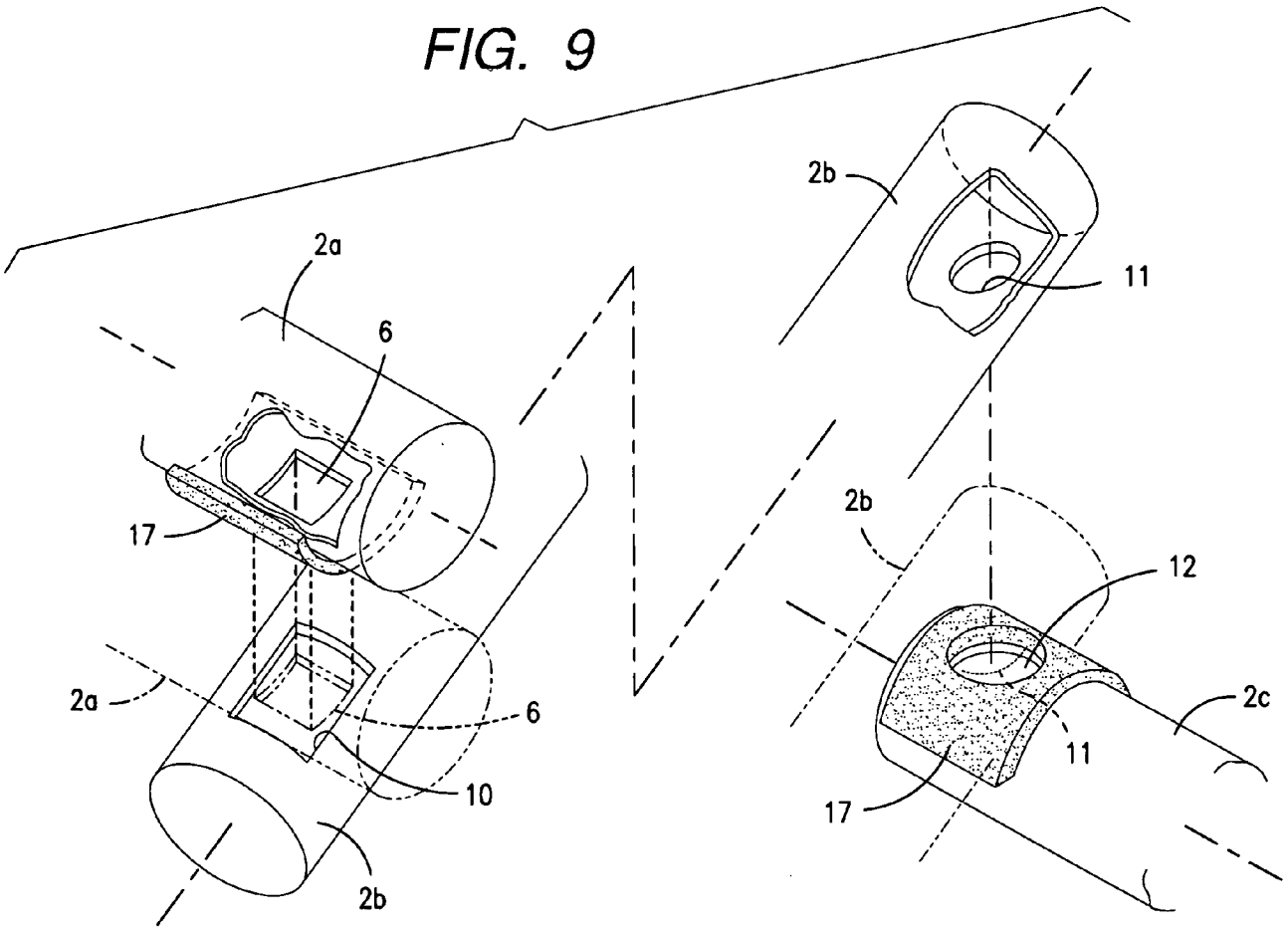
FIG. 9 is a view showing a configuration between an aperture for waste toner outlet and an aperture for waste toner inlet in connecting portions of the first to third carrying tubes.

In case the aperture is formed not on the lateral face but on the bottom face relative to the carrying direction in the carrying tube, in a lower face in an end portion of the first carrying tube 2*a* at the downstream side in the toner carrying direction, there is provided a waste toner outlet aperture (rectangular hole) 6 for transferring the waste toner to the second carrying tube, as shown in FIGS. 4, 5 and 9. Also in a peripheral area around the waste toner outlet aperture 6 on the lower face of the first carrying tube 2*a*, a sealing material 17 such as of Moltopren of a thickness of about 1 mm is adhered, in order to prevent leakage of the waste toner from a connecting portion between the waste toner outlet aperture 6 and a waste toner inlet aperture 10 of the second carrying tube 2*b* to be explained later.

Figure 11:
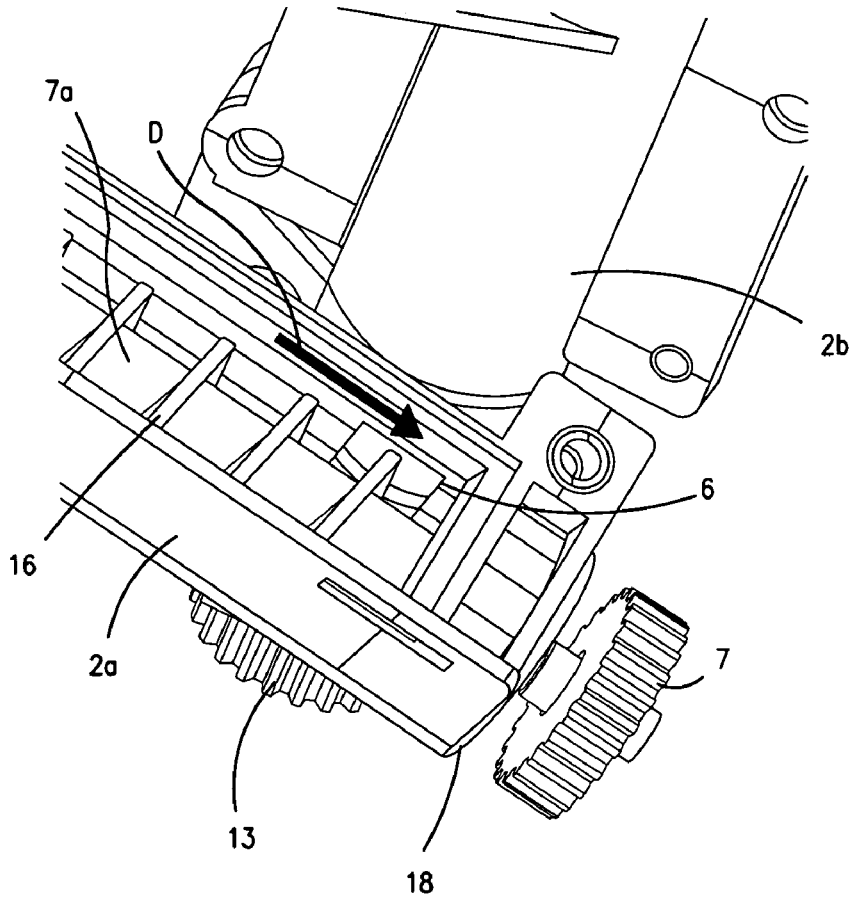
FIG. 11 is a partially cut-off perspective view of a connecting portion of the first and second carrying tubes, seen from the upper side of the first carrying tube (aperture being provided in a lower or lateral face of the carrying tube)

Also in the first carrying tube 2*a*, the spiral portion 16 of the first carrying screw 7*a*, constituting the waste toner carrying means, is terminated, as shown in FIGS. 4, 5 and 11, in a position within the range of the waste toner outlet aperture 6. Thus, the outlet aperture 6 for transferring the waste toner to the second carrying tube 2*b* is formed on a lateral face of the first carrying tube 2*a* and is provided in a position covering a part where the first carrying screw 7*a* has a spiral portion 16 and a part where the first carrying screw 7*a* does not have the spiral portion 16. The part not having the spiral portion 16 includes a part showing a change in the carrying direction by a reverse screw or a part showing a change in the carrying power by a change in the screw pitch. A lateral face of the carrying tube corresponds to a left or right wall relative to the carrying direction of the waste toner. In such case where an aperture, formed not on the bottom face of the carrying tube in the gravitationally lower direction but deviated to left or right along the circumference (namely a state where an aperture formed in the gravitationally lower face (bottom face) of a cylindrical hollow tube is rotated by an angle q ($0°<q<360°$) about an axis along the carrying direction) is jointed to an aperture of another carrying tube, different from the case of connection to the bottom face of the carrying tube, the toner transfer by carrying (dropping) by the weight of the toner is not possible or becomes weaker, so that it is necessary to secure the carrying power to the lateral direction. On the other hand, if the carrying power of the upstream side is large at the connecting portion, there results a compression of the toner at the aperture, at the end of the screw, or in a portion after passing the aperture, and there is required a measure for preventing toner clogging.

Therefore, in the present embodiment, the spiral portion of the carrying screw of the upstream carrying tube is interrupted within the range of the aperture to reduce the carrying power thereby preventing toner clogging, and a compressive force generated by the toner carried from the upstream side is utilized to generate a carrying power in the horizontal (lateral) direction from a position in the aperture where the carrying power is reduced by the interruption of the spiral portion toward the downstream carrying tube, thereby enabling transfer (guiding) of the waste toner at the connecting portion.

Particularly in case the downstream side of the aperture executes upward carrying, as in the first carrying tube 2*a* and the second carrying tube 2*b* in the present embodiment, since the second carrying tube 2*b* has to execute carrying against the gravity, the carrying amount is reduced in comparison with horizontal or downward carrying thereby easily causing toner stagnation at the aperture part and toner compression between the upstream and downstream sides, but the afore-mentioned configuration allows to avoid excessive compression of the toner between the upstream and downstream sides, thereby achieving stable toner carrying while preventing toner clogging.

Also in case the downstream side of the aperture executes an upward carrying, as in the first carrying tube 2*a* and the second carrying tube 2*b* in the present embodiment, the carrying screw in the first carrying tube 2*a* is preferably, at the connecting portion with the second carrying tube 2*b*, a carrying screw as shown in FIG. 5. The toner carrying is achieved by a rotation of a spiral portion of the carrying screw, inclined in the carrying direction, and, when observed through a connecting aperture of the first carrying tube 2*a* and the second carrying tube 2*b*, the toner carrying is achieved by a rotation of the spiral portion of the carrying screw from a gravitationally lower side to an upper side. Stated differently, when observed through the aperture, the toner is carried forward in a state of being lifted from the gravitationally lower side to the upper side. Such configuration enables a smooth transfer from the first carrying tube 2*a* of horizontal carrying to the second carrying tube 2*b* of upward carrying.

In the following, there will be explained a case where the aperture is provided not on the lateral face but on the bottom face of the carrying tube. When the motor 9 is rotated in the forward (normal) direction, the driving power thereof is transmitted through the first drive gear train 8*a* to the gear 7 of the first carrying tube 2*a*, whereby the first carrying screw 7*a* is rotated in the waste toner carrying direction. Thus, the waste toner, discharged from the cleaning devices "d" of the first to fourth image forming units Y, M, C, Bk and the intermediate transfer belt cleaning device 23 into the first carrying tube 2*a* is collectively carried in the first carrying tube 2*a*, and drops by gravity from the downward waste toner outlet aperture 6, provided at the lower face at the downstream end in the waste toner carrying direction, into the second carrying tube 2*b* through the upward waste toner inlet aperture 10 (FIG. 9) therein.

2) Second Carrying Tube 2*b*

Figure 7C:
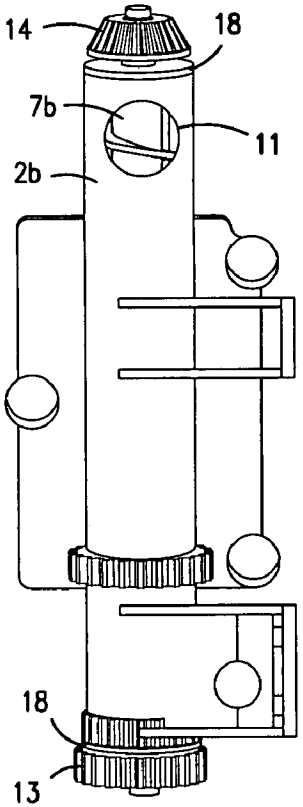
FIGS. 7A, 7B and 7C are views (1 of 2) showing a configuration of a second carrying tube.
Figure 7B:
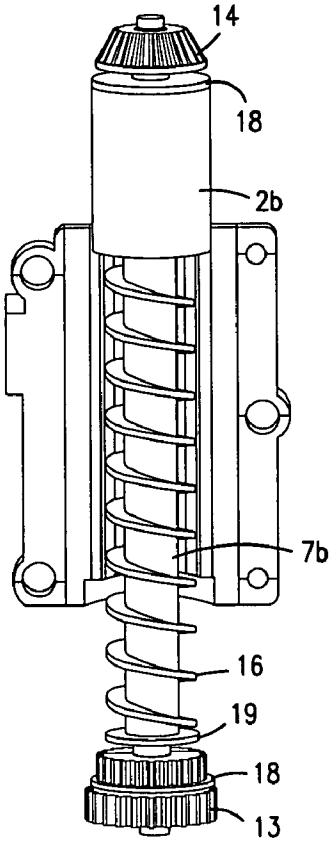
Figure 7A:
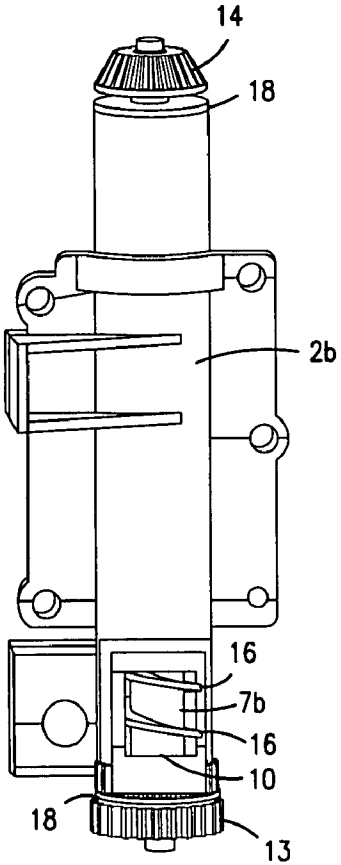
Figure 8B:
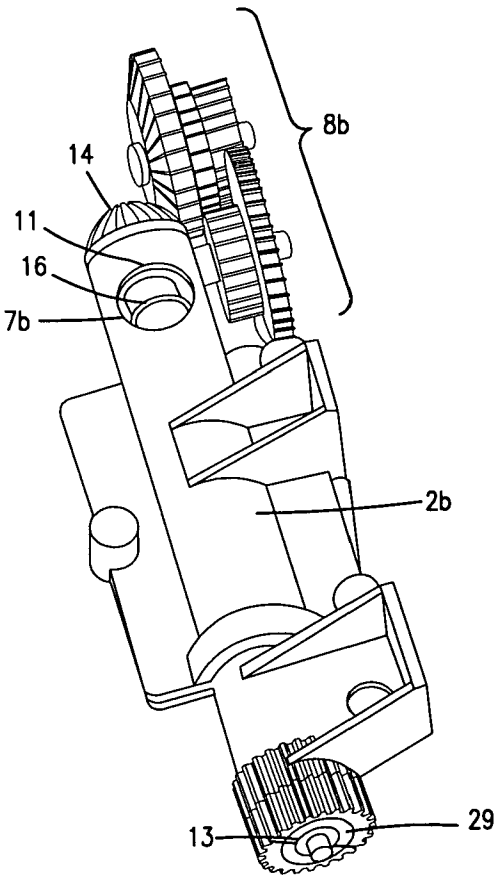
FIGS. 8A and 8B are views (2 of 2) showing a configuration of the second carrying tube.
Figure 8A:
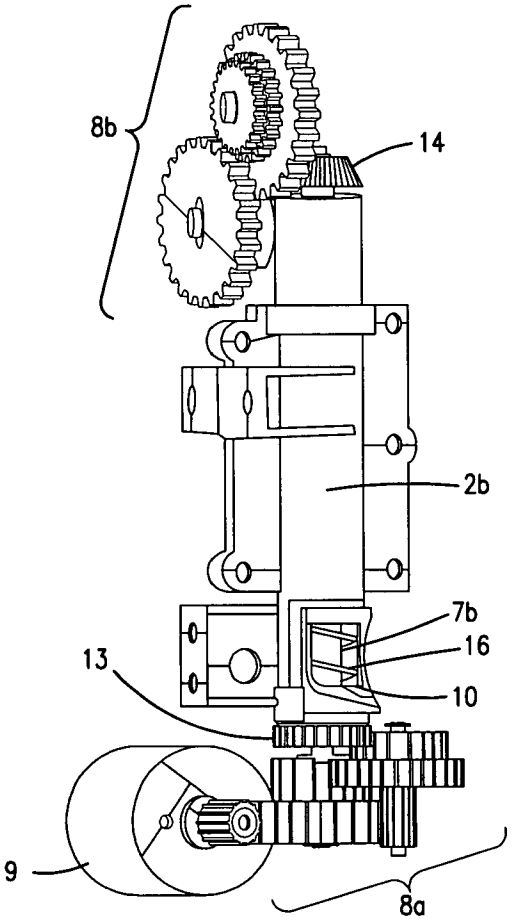

The second carrying tube 2*a* is also a straight tube member of a hard material incorporating a carrying screw of a drill type having a spiral portion around a shaft. FIGS. 7A, 7B and 7C are respectively a plan view, a partially cut-off perspective view and a bottom view of the second carrying tube 2*b*. As shown in FIGS. 7A, 7B and 7C, inside the second carrying tube 2*b*, a second carrying screw 7*b* is supported rotatably at the ends thereof between bearings 18 provided on both ends of the second carrying tube 2*b*. The shaft of the second carrying screw 7*b* protrudes from the bearings 18 at the upstream and downstream sides in the waste toner carrying direction, and the protruding shaft at the upstream side is provided with a gear 13 across a one-way clutch 29 (FIGS. 3 and 8B), while the protruding shaft at the downstream side is provided with a gear 14. FIGS. 8A and 8B are respectively a plan view and a bottom view of the second carrying tube 2*b*. The forward driving power of the motor 9 is transmitted to the gear 13, at the upstream side in the toner carrying direction, through the first drive gear train 8*a*, thereby rotating the second carrying screw 7*b* through the one-way clutch 29. Together with the second carrying screw 7*b*, the gear 14 at the downstream side in the waste toner carrying direction is also rotated.

A clearance between the external radial end of the carrying screw 7*b* and the internal wall of the carrying tube 2*b* is maintained minimum within an extent that the carrying screw 7*b* does not touch the internal wall of the carrying tube 2*b*. At the internal side of the bearing 18, there is also provided a sealing material (not shown) such as of Moltopren, in order to prevent leakage of the waste toner from the bearing portion.

The second carrying tube 2*b* is provided, as shown in FIGS. 7A, 7B, 7C, 8A, 8B and 9, in an upper face at the upstream end in the waste toner carrying direction, with a waste toner inlet aperture (rectangular hole) 10 for receiving the waste toner from the waste toner outlet aperture 6 of the first carrying tube 2*a*, and, in a lower face at the downstream end in the waste toner carrying direction, with a waste toner outlet aperture (circular hole) 11 for transferring the waste toner to the third carrying tube 2*c*. In the present embodiment, the waste toner inlet aperture 10 is made larger than the waste toner outlet aperture 6 of the first carrying tube 2*a*.

The waste toner inlet aperture 10 of the second carrying tube 2*b* for receiving the waste toner from the waste toner outlet aperture 6 of the first carrying tube 2*a* is provided at a lateral face of the second carrying tube 2*b*, and, as shown in FIGS. 7A, 7B, 7C, 8A, 8B and 12, in a position where a spiral portion 16 is present on the shaft of the second carrying screw 7*b* as the waste toner carrying means in the second carrying tube 2*b* thereby providing a waste toner carrying power. Also as shown in FIGS. 7A, 7B, 7C, 8A and 8B, the spiral portion 16 of the second carrying screw 7*b* is interrupted, at the downstream side in the waste toner carrying direction, in a position within the range of the waste toner outlet aperture 11.

The afore-mentioned second carrying tube 2*b* is fixedly supported by a supporting plate or a frame of the main body of the image forming apparatus for example with screws, in such a position that an upstream end in the waste toner carrying direction is located under the downstream end in the waste toner carrying direction of the first carrying tube 2*a*, where the upward waste toner inlet aperture 10 of the second carrying tube 2*b* is contacted with the downward waste toner outlet aperture 6 of the first carrying tube 2*a* across the sealing material 17 to achieve a communicating connection of the first and second carrying tubes 2*a*, 2*b*, and that the downstream side of the second carrying tube 2*b* in the waste toner carrying direction is maintained in a predetermined upward position toward the right side plate 20*d* of the outer casing.

The second carrying screw 7*b* in the second carrying tube 2*b* is rotated in the waste toner carrying direction, by the driving power transmitted from the motor 9 through the first drive gear train 8*a*, the gear 13 and the one-way clutch 29. By the rotation of the second carrying screw 7*b*, the waste toner, dropped into the second carrying tube 2*b* through the downward waste toner outlet aperture 6 of the first carrying tube 2*a* and the upward waste toner inlet aperture 10 of the second carrying tube 2*b*, is carried upwards in the second carrying tube 2*b*, and then drops into the third carrying tube 2*c* from the downward waste toner outlet aperture 11, provided in a lower face in a downstream end portion in the waste toner carrying direction, through an upward waste toner inlet aperture 12 (FIG. 9) of the third carrying tube 2*c* to be explained in the following.

Figure 10:
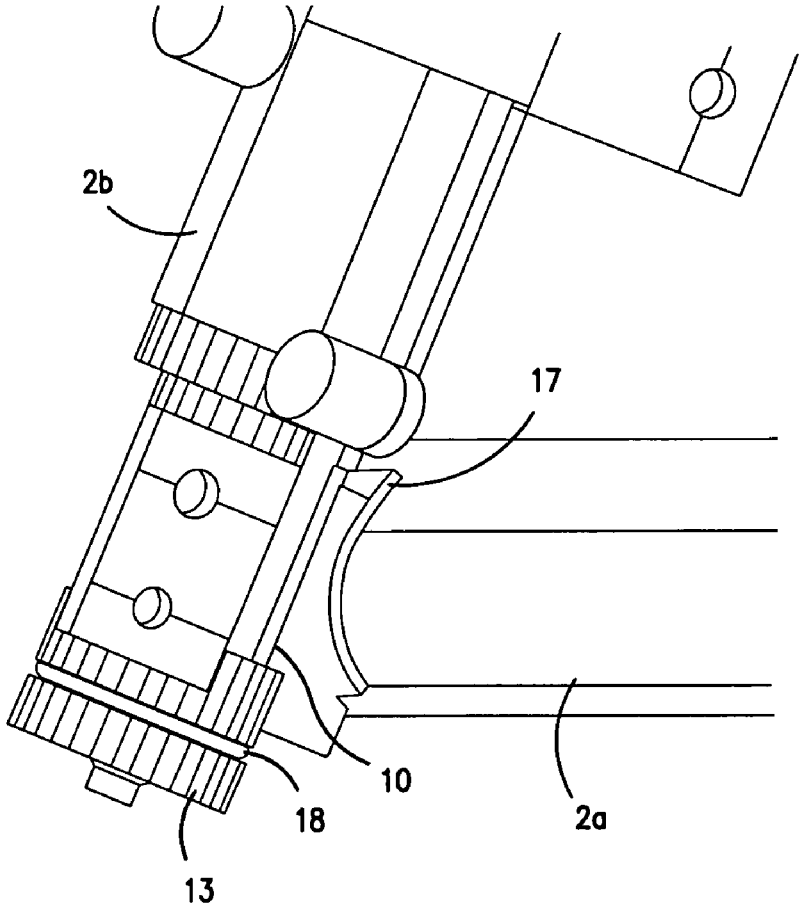
FIG. 10 is a perspective view of a connecting portion of the first and second carrying tubes (aperture being provided in a lower or lateral face of the carrying tube)

Now a waste toner transfer portion from the first carrying tube 2*a* to the second carrying tube 2*b* (connecting portion of the tubes 2*a* and 2*b*) will be explained in detail with reference to FIGS. 10 to 12.

The waste toner outlet aperture 6 of the first carrying tube 2*a* and the waste toner inlet aperture 10 of the second carrying tube 2*b* are both rectangular holes, and the second carrying tube 2*b* is fixed in a state where the inlet and outlet apertures are mutually opposed to achieve a communicating connection. In the connecting portion, a sealing material 17 such as of Moltopren for preventing powder leakage is sandwiched, but no such connection assisting member is provided as to form a distance between the apertures 6 and 10. Such communicating connection by mutually opposed arrangement of the apertures allows to dispense with an auxiliary member for powder discharge in the vicinity of the waste toner outlet aperture of the first carrying tube 2*a*.

The afore-mentioned connecting method of the apertures 6, 10 and the positional relationship of the outlet aperture 6, inlet aperture 10 and the screws 7*b*, 7*a* are effective for achieving stable carrying regardless of an angle formed by the first carrying tube 2*a* and the second carrying tube 2*b* or the carrying direction such as upward carrying or horizontal carrying, and capable of preventing clogging at the connecting portion of the carrying tubes and achieving a space saving in the entire powder carrying apparatus.

Figure 12:
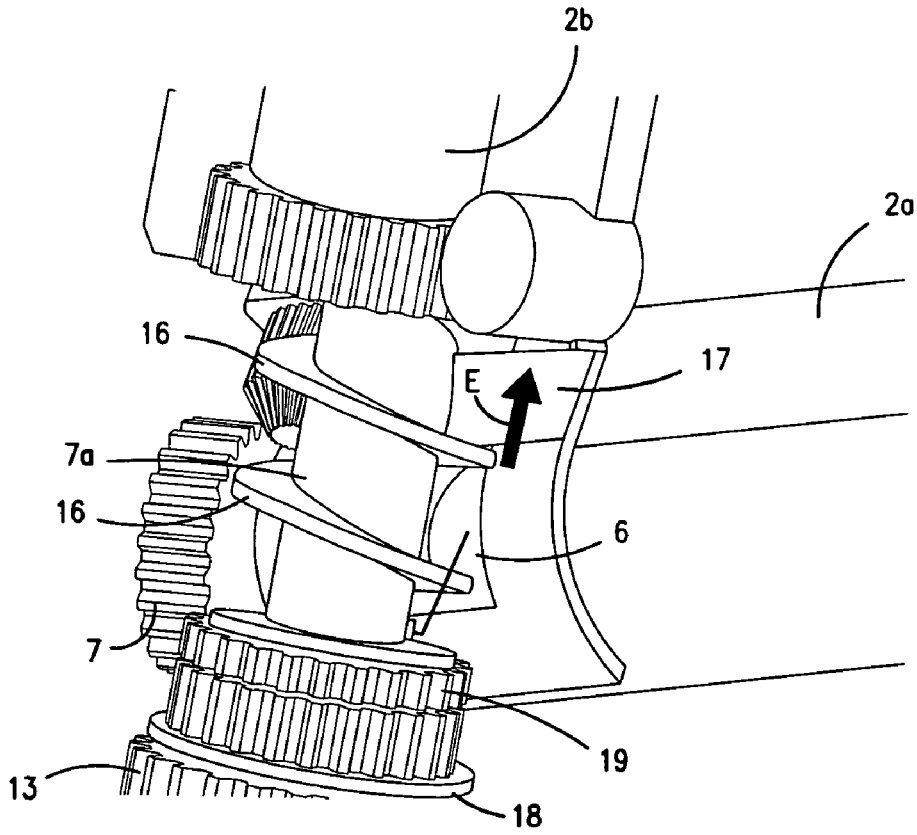
FIG. 12 is a partially cut-off perspective view of a connecting portion of the first and second carrying tubes, (aperture being provided in a lower or lateral face of the carrying tube)

FIGS. 11 and 12 are perspective views of a transfer portion between the first carrying tube 2*a* and the second carrying tube 2*b*. In case the second carrying tube 2*b* executes upward carrying of the waste toner as in the present embodiment, the waste toner carried to a position, in the waste toner outlet aperture 6 of the first carrying tube 2*a*, where spiral portion 16 is terminated on the carrying screw 7*a* as indicated by an arrow D loses the carrying power and is thus stopped, but is pushed toward the outlet aperture 6 of the first carrying tube 2*a* by the waste toner carried in succession from the rear, thus being guided into the second carrying tube 2*b*. The waste toner, guided as indicated by an arrow E in FIG. 12, drops by the gravity onto a lower end face in the second carrying tube 2*b*. As the spiral portion 16 of the second carrying screw 7*b* is present under the lower edge of the waste toner inlet aperture 10 of the second carrying tube 2*b*, the dropping waste toner is scooped up again and is elevated by the second carrying screw 7*b* in the second carrying tube 2*b*.

Figure 16:
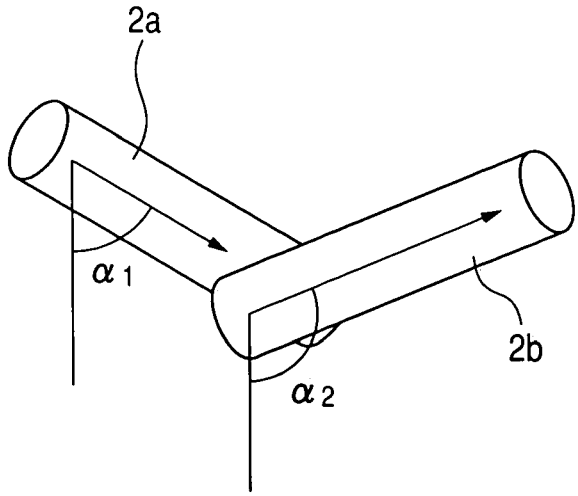
FIG. 16 is a view showing angles formed by carrying directions of the first and second carrying tubes and a gravitationally downward direction.

The dimensions relating to the carrying speed of the carrying screws 7*a*, 7*b*, such as a pitch, a screw outer diameter, a shaft diameter etc. are made to be the same in the first carrying tube 2*a* and the second carrying tube 2*b*, so that the carrying speed in the carrying tube is varied by the revolution of the carrying screw. The waste toner carrying speed in the second carrying tube 2*b* is made to be twice that of the first carrying tube 2*a*, in order to prevent toner clogging at the transfer portion. In more general terms, the carrying speed becomes smaller with an increase in an angle $\alpha$, formed between the carrying direction of the carrying tube and the gravitationally downward direction, as shown in FIG. 16. Therefore, $\alpha$1 of an upstream carrying tube and $\alpha$2 of a downstream carrying tube with respect to the aperture are compared, and, in case the angle $\alpha$ is larger in the downstream side than in the upstream side, the carrying amount per unit time is made larger in the downstream side to prevent toner clogging resulting from an inclination of the carrying tubes.

3) Third Carrying Tube 2*c*

Figure 13A:
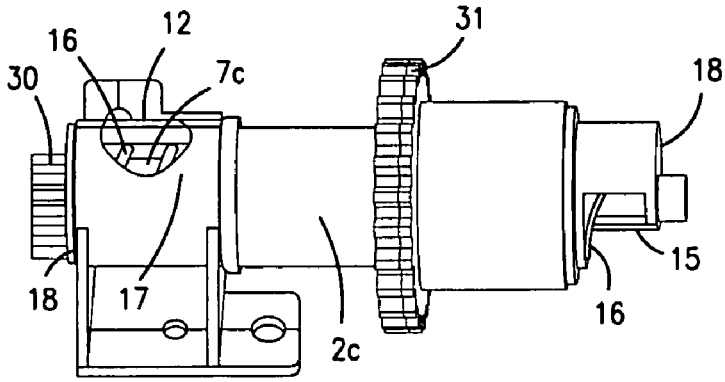
FIGS. 13A and 13B are views showing a configuration of the third carrying tube.
Figure 13B:
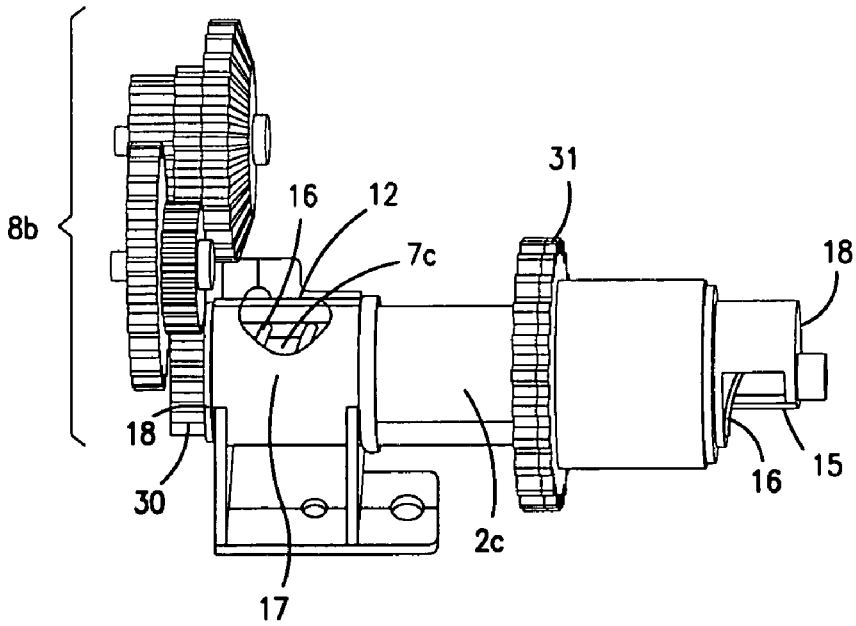
Figure 14:
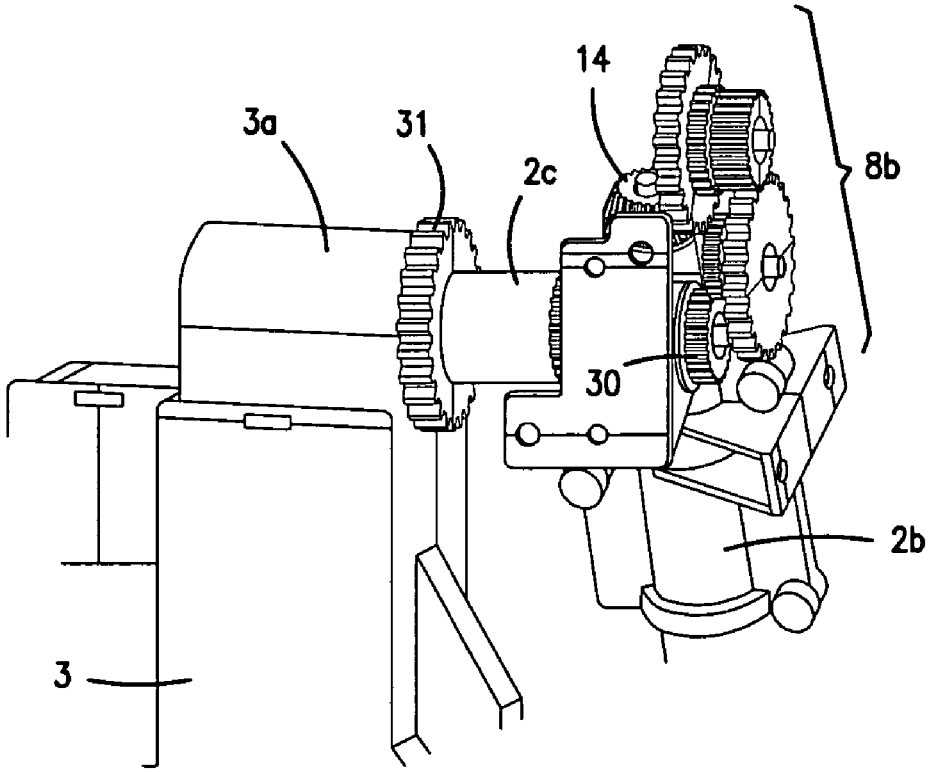
FIG. 14 is a perspective view of the third carrying tube and a part of a waste toner container.
Figure 15A:
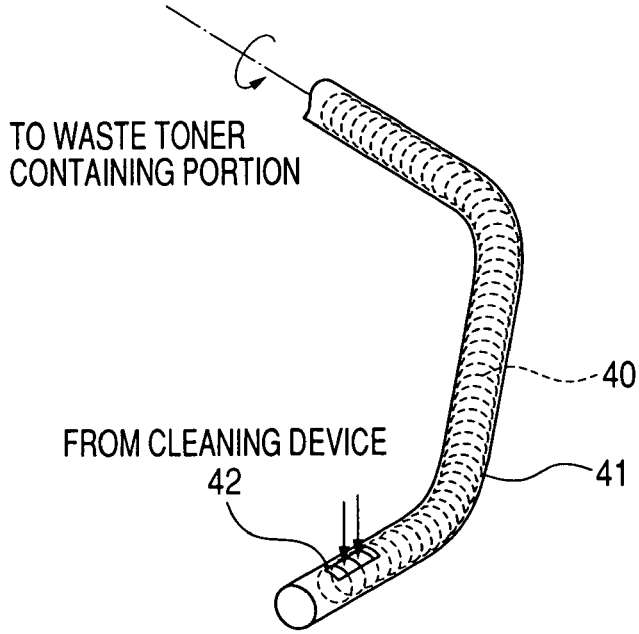
FIGS. 15A and 15B are views showing a prior waste toner carrying apparatus utilizing a flexible screw.
Figure 15B:
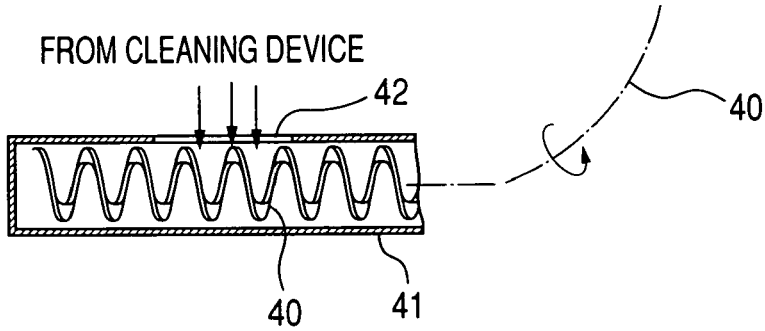

The third carrying tube 2*c* is also a straight tube member of a hard material incorporating a carrying screw of a drill type as carrying means. As shown in FIGS. 13A and 13B, inside the third carrying tube 2*c*, a third carrying screw 7*c* of a drill type is supported rotatably at the ends thereof between bearings 18 provided on both ends of the third carrying tube 2*c*. The shaft of the third carrying screw 7*c* protrudes from the bearing 18 at the upstream side in the waste toner carrying direction, and is provided with a gear 30, which is connected through a second drive gear train 8*b* with a gear 14 provided at the downstream end in the waste toner carrying direction of the second carrying screw 7*b* in the second carrying tube 2*b* (FIGS. 3, 8A, 8B, 13A, 13B, and 14). The second drive gear train 8*b* is fixedly supported on a supporting plate or a frame in the main body of the image forming apparatus, for example with screws.

The third carrying screw 7*c* of the third carrying tube 2*c* rotates in linkage with the rotation of the carrying screw 7*b* of the second carrying tube 2*b*. More specifically, the gear 14, rotated by the second carrying screw 7*b* in the second carrying tube 2*b*, transmits rotary driving power through the second drive gear train 8*b* to the gear 30, thereby rotating the third carrying screw 7*c*. A clearance between the external radial end of the third carrying screw 7*c* and the internal wall of the third carrying tube 2*c* is maintained minimum within an extent that the third carrying screw 7*c* does not touch the internal wall of the third carrying tube 2*c*. At the internal side of the bearing 18, there is also provided a sealing material (not shown) such as of Moltopren, in order to prevent leakage of the waste toner from the bearing portion.

The third carrying tube 2*c* is provided, on an upper face at the upstream end in the waste toner carrying direction, as shown in FIGS. 8, 13A and 13B, with an upward waste toner inlet aperture (circular hole) 12 for receiving the waste toner from the waste toner outlet aperture 11 of the second carrying tube 2*b*, and, on a lower face at the downstream end in the waste toner carrying direction, with a downward waste toner outlet aperture 14 for dropping the waste toner into a recovery container 3. In the present embodiment, the waste toner inlet aperture 12 is made larger than the waste toner outlet aperture 11 of the second carrying tube 2*b*. Also in a peripheral area around the waste toner inlet aperture 12 on the upper face of the third carrying tube 2*c*, a sealing material 17 such as of Moltopren of a thickness of about 1 mm is adhered, in order to prevent leakage of the waste toner from a connecting portion with the waste toner inlet aperture 12 on the upper face of the third carrying tube 2*c*.

Also the waste toner inlet aperture 12 of the third carrying tube 2*c* is provided in a position where the third carrying screw 7*c* constituting the waste toner carrying means in the third carrying tube 2*c* has a carrying power, namely in a position corresponding to a spiral portion 16 of the third carrying screw 7*c* as shown in FIGS. 13A and 13B. Also the spiral portion 16 of the third carrying screw 7*c* is terminated, at the downstream side in the waste toner carrying direction, in a position within the range of the waste toner outlet aperture 13 as shown in FIGS. 13A and 13B.

The afore-mentioned third carrying tube 2*c* is fixedly supported by a supporting plate or a frame in the main body of the image forming apparatus, for example by screws, in such a substantially horizontal position that an upstream end in the waste toner carrying direction is located under the downstream end in the waste toner carrying direction of the second carrying tube 2*b* whereby the downward waste toner outlet aperture 11 of the second carrying tube 2*b* is opposed to the upward waste toner inlet aperture 12 of the third carrying tube 2*c* with the sealing material 17 therebetween to achieve communicating connection of the second and third carrying tubes 2*b*, 2*c*, and wherein the downstream side in the waste toner carrying direction is directed toward the right side plate 20*d* of the outer casing.

By the rotation of second carrying screw 7*b* in the second carrying tube 2*b*, the waste toner is carried upwards therein and drops into the third carrying tube 2*c* through the downward waste toner outlet aperture 11 provided at the lower face in the downstream end in the waste toner carrying direction and the upward waste toner inlet aperture 12 of the third carrying tube 2*c*. The waste toner dropped into the third carrying tube 2*c* is carried horizontally toward the recovery container 3 by the third carrying screw 7*c* in the third carrying tube 2*c*, and drops and is contained in the recovery container 3 through the downward waste toner outlet aperture 13 provided in the lower face at the downstream end in the waste toner carrying direction of the third carrying tube 2*c*.

The waste toner transfer portion from the second carrying tube 2*b* to the third carrying tube 2*c* (connecting portion of the tubes 2*b* and 2*c*) is constructed similarly to the waste toner transfer portion from the first carrying tube 2*a* to the second carrying tube 2*b* (connecting portion of the tubes 2*a* and 2*b*). In the present embodiment, the waste toner outlet aperture 11 of the second carrying tube 2*b* and the waste toner inlet aperture 12 of the third carrying tube 2*c* are both circular holes, and such circular inlet and outlet holes are fixed in such a manner that the edges thereof are mutually in contact. In the connecting portion, a sealing material 17 such as of Moltopren for preventing powder leakage is sandwiched, but no such connection assisting member is provided as to form a distance between the apertures 11 and 12. Such communicating connection by mutually opposed arrangement of the apertures allows to dispense with an auxiliary member for powder discharge in the vicinity of the waste toner outlet aperture of the second carrying tube 2*b*.

The afore-mentioned connecting method of the apertures 11, 12 and the positional relationship of the outlet aperture 11, inlet aperture 12 and the screws 7*c*, 7*b* are also similar to the afore-mentioned case between the first carrying tube 2*a* and the second carrying tube 2*b*, and are effective for achieving stable carrying regardless of an angle formed by the second carrying tube 2*b* and the third carrying tube 2*c* or the carrying direction such as upward carrying or horizontal carrying, and capable of preventing clogging at the connecting portion of the carrying tubes and achieving a space saving in the entire powder carrying apparatus. The waste toner carried upward the second carrying tube 2*b* is brought to a position, in the waste toner outlet aperture 11, where spiral portion 16 is terminated on the second carrying screw 7*b* and is thus stopped, but is pushed toward the outlet aperture 11 of the second carrying tube 2*b* by the waste toner carried in succession from the rear, thus being guided into the third carrying tube 2*c* and drops by the gravity onto a lower end face in the third carrying tube 2*c*. As the spiral portion 16 of the third carrying screw 7*c* is present under the lower edge of the waste toner inlet aperture 12 of the third carrying tube 2*c*, the dropping waste toner is carried toward the waste toner outlet aperture 13, drops and is contained from the waste toner outlet aperture 13 into the recovery container 3.

4) Recovery Container 3

The recovery container 3 is for example a plastic molded container, and can be detached from or attached in a predetermined mounting position in the image forming apparatus, by opening the front plate 20*a* formed as an open-closable door in the outer casing. The recovery container 3 is provided, on an upper part thereof, with a toner carrying path receiving portion (container inlet hood) 3(*a*). The recovery container 3 can be mounted into the image forming apparatus by opening the front plate 20*a* of the outer casing, placing the container in a container setting portion (not shown) in a state in which the downstream end of the third carrying tube 2*c* in the waste toner carrying direction is inserted into the toner carrying path receiving portion 3*a* of the recovery container 3 until the toner carrying path receiving portion 3*a* is received by a flat 31 provided on the third carrying tube 2*c*, and closing the front plate 20*a*. The detachment is achieved according to an inverse procedure.

5) Drive System

In the waste toner carrying apparatus 1 of the present embodiment, all the first to third carrying screws 7*a*, 7*b*, 7*c* respectively contained in the first to third carrying tubes 2*a*, 2*b*, 2*c*, constituting the apparatus, are driven by a single motor 9 as a same drive source.

In FIG. 3, there are shown a control circuit 100 and a power source circuit 101 for the motor 9. The control circuit 100 is provided with two operation control modes, namely a linked control mode (normal drive) in which all the first to third carrying screws 7*a*, 7*b*, 7*c* are driven in the forward direction in the waste toner discharging direction, and a non-linked control mode in which the first carrying screw 7*a* alone is driven in a direction for reversing the waste toner.

The control circuit 100 is normally maintained in the linked control mode, and control the power source circuit 101 so as to drive the motor 9 in the forward direction at the image forming operation of the image forming apparatus.

The forward driving power of the motor 9 is transmitted through the first drive gear train 8*a* and the gear 7 to the first carrying screw 7*a* of the first carrying tube 2*a*, whereby the first carrying screw 7*a* is rotated in the forward direction for discharging the waste toner. Also the forward driving power of the motor 9 is transmitted through the first drive gear train 8*a* and the gear 13 to the second carrying screw 7*b* of the first carrying tube 2*b*, whereby the second carrying screw 7*b* is rotated in the forward direction for discharging the waste toner. Further, the forward driving power of the second carrying screw 7*b* is transmitted through the gear 14, the second drive gear train 8*b* and the gear 30 to the third carrying screw 7*c* of the third carrying tube 2*c*, whereby the third carrying screw 7*c* is rotated in the forward direction for discharging the waste toner. In this manner, in the first to third carrying tubes 2*a*, 2*b*, 2*c* constituting the waste toner carrying apparatus 1, all the first to third carrying screws 7*a*, 7*b*, 7*c* respectively contained therein are driven by a single motor 9 constituting the single drive source.

The non-linked control mode is a control mode for eliminating a toner clogging, in case such toner clogging is generated at the connecting portion between the first carrying tube 2*a* and the second carrying tube 2*b*.

The waste toner clogging at the connecting portion between the first carrying tube 2*a* and the second carrying tube 2*b* is detected in the following manner.

The motor 9 employed in the present embodiment is a DC motor, which has a feature of showing a change in the current according to the driven load. In the normal drive state, the motor 9 is operated at a designed current. In the present embodiment, an ammeter 103 is provided in a current supply path to the motor 9 for reading a current therein, and, when the current detected by the ammeter 103 reaches a certain current value or becomes higher, a stop apparatus 104 turns off the power supply circuit 101 through the control circuit 100 thereby stopping the motor 9. The ammeter 103 and the stop apparatus 104 constitute in combination a lock detection mechanism 102 for the carrying screw.

When the waste toner is clogged in any position in the first to third carrying tubes 2*a*, 2*b*, 2*c* thereby increasing the rotational load of the first to third carrying screws 7*a*, 7*b*, 7*c*, the current detected by the ammeter 103 increases according to such load. A current at an overload causing a screw locking is memorized in advance as a threshold value in the stop apparatus 104, and the motor 9 is stopped when the ammeter 103 detects a value exceeding the threshold value.

In the waste toner carrying path from the first carrying tube 2*a* to the recovery container 3 in the waste toner carrying apparatus 1, the clogging of the waste toner takes place mostly at the connecting portion between the first carrying tube 2*a* and the second carrying tube 2*b*, and, in case the motor 9 is stopped by the function of the lock detection mechanism 102 for the carrying screws, the clogging of the waste toner can be almost certainly considered to have occurred at the connecting portion between the first carrying tube 2*a* and the second carrying tube 2*b*.

When the motor 9 is stopped by the function of the lock detection mechanism 102, the control circuit 100 at the same time urgently interrupts the printing operation of the image forming apparatus, and executes an error display, indicating a waste toner clogging, on a display portion 106 of an operation unit. Based on such error display, the operator selects the non-linked control mode by a mode selection key 105. Thus the control circuit 100 controls the power source circuit 101 so as to reverse the motor 9. The reverse driving power of the motor 9 is transmitted through the first drive gear train 8*a* and the gear 7 to the first carrying screw 7*a* of the first carrying tube 2*a*, whereby the first carrying screw 7*a* is driven in the reverse direction for returning the waste toner. In this case, the reverse driving power of the motor 9 is also transmitted through the first drive gear train 8*a* to the gear 13 of the second carrying tube 2*b*, whereby the gear 13 is driven in the reverse direction, but the second carrying screw 7*b* is not rotated in the reverse direction and remains in a stopped state, because the one-way clutch 29 positioned between the gear 13 and the second carrying screw 7*b* does not transmit the reverse driving power of the gear 13 to the shaft of the second carrying screw 7*b*. Also the third carrying screw 7*c* of the third carrying tube 2*c*, rotated in linkage with the rotation of the second carrying screw 7*b*, is maintained in a stopped state. Therefore, in the non-linked control mode, the first carrying screw 7*a* of the first carrying tube 2*a* alone is rotated in the reverse direction for reversing the waste toner, whereby the waste toner causing clogging at the connecting portion between the first carrying tube 2*a* and the second carrying tube 2*b* is reverse carried in the first carrying tube 2*a*, thereby eliminating the clogging of the waste toner. The control circuit 100, after reversing the motor 9 for a predetermined time sufficient for removing the clogging of the waste toner, erases the error display, automatically switches the non-linked control mode to the linked control mode, releases the urgent stop state of the image forming apparatus and displays a print enabled state on the display portion 106, thereby requesting the operator to re-start the printing operation.

For eliminating the toner clogging, it is also possible, instead of utilizing the motor 9, to form a groove in the shaft of the carrying screw and rotating the carrying screw with a screw driver or with a coin. Though not illustrated, a one-way clutch is provided between the first carrying screw 7*a* and the gear 7 in this case. By rotating the shaft of the first carrying screw 7*a* by the screw driver or the coin in a direction opposite to the direction for discharging the waste toner, there can be realized a non-linked control mode in which the first carrying screw 7*a* alone is rotated in the reverse direction, thereby enabling to eliminate the clogging of the waste toner at the connecting portion of the first carrying tube 2*a* and the second carrying tube 2*b*.

As the non-linked control mode, there can also be adopted a configuration in which the first carrying screw 7*a* is not rotated and the second carrying screw 7*b* alone is rotated in the carrying direction. The rotation of the second carrying screw 7*b* alone allows the waste toner to be carried in the connecting portion thereby eliminating the clogging. In this method, the motor 9 need not be rotated in the reverse direction, but drive switching means such as a clutch has to be provided.

In the present embodiment, since all the carrying screws 7*a*, 7*b*, 7*c* are driven by the single motor 9, there is required only one lock detection mechanism 102 thereby enabling a compact structure and a cost reduction of the apparatus.

In the present embodiment, the change in the load is detected by reading the current in the DC motor, but it is also possible to construct the lock detection mechanism by providing means capable of reading a variation in the motor revolution by a combination of a motor and an encoder, and detecting an overload in case of a decrease in the revolution.

In case of employing an AC motor such as a stepping motor instead of the DC motor, the lock detection is possible utilizing a fact that the motor is desynchronized in an overload state. However, a stepping motor is immediately desynchronized beyond a desynchronization limit to lock the drive, so that it is difficult to respond to the actual variation or fluctuation in the load. A motor with a low limit torque of desynchronization causes a locking even by a slight increase in the load by an external perturbation. On the other hand, a motor with a high limit torque of desynchronization does not cause a locking even in an overload, there leading for example to a gear breakage.

Also in the waste toner carrying path constituted of the first to third carrying tubes 2*a*, 2*b*, 2*c* of the present embodiment, in order to prevent clogging of the waste toner, the waste toner carrying amount is selected equal or larger in the downstream carrying tube in comparison with the upstream carrying tube. In the present embodiment, the waste toner carrying amount of the second carrying screw 7*b* of the second carrying tube 2*b* is selected as twice of that of the first carrying screw 7*a* of the first carrying tube 2*a*, and the waste toner carrying amount of the third carrying screw 7*c* of the third carrying tube 2*c* is selected approximately equal to that of the first carrying screw 7*a* of the first carrying tube 2*a*.

In the present embodiment, the first carrying screw 7*a* and the second carrying screw 7*b* are of a substantially same shape, same in the shaft diameter, external screw diameter and screw pitch, and a carrying amount per rotation of screw is equivalent in the first carrying screw 7*a* and the second carrying screw 7*b*. The ratio of the carrying amounts per unit time of the first carrying screw 7*a* and the second carrying screw 7*b* is set by the ratio of revolutions of the screws. The ratio of revolutions can be selected only by the gear ratio of the first drive gear train 8*a*, thus achievable by easy designing and allowing reducing the kinds of the screws.

Because of the common drive by the motor 9, a fluctuation in the revolution of the motor 9 is given equally to the first carrying screw 7*a* and the second carrying screw 7*b*. In case the revolution of the motor 9 is lowered, the waste toner carrying amounts in the first carrying screw 7*a* and the second carrying screw 7*b* are equally lowered, so that the ratio of the carrying amounts set by the reducing ratio of the first drive gear train 8*a* is scarcely affected. In case the carrying screws are independently driven by plural motors, a fluctuation in the revolution of any motor changes the revolution ratio to other motors, whereby the ratio of the waste toner carrying amounts of the first carrying screw 7*a* and the second carrying screw 7*b* is disturbed thereby leading to a screw locking phenomenon.

6) Others a: The carrying means incorporated in the carrying tube may be, instead of a screw supported on both ends as in the apparatus of the embodiment, constructed also by a screw supported only at a driving side or a flexible screw formed by a spiral portion only and not having a shaft, but there are required plural driving motors in such case. A screw supported on both ends of the shaft is most effective in consideration of stability of the carrying amount and a little fluctuation in the driven load.

b: Number of the carrying tubes constituting the powder carrying apparatus is not limited three tubes employed in the embodiment, and the powder carrying apparatus can be constructed with any number of tubes equal to or larger than two. There can also be constructed a powder carrying apparatus having a powder carrying path of a branched form.

c: The powder carrying apparatus of the present invention is effective not only as a waste toner carrying apparatus for an image forming apparatus, but also as an apparatus for smoothly carrying powder or granular material such as salt, wheat flour, rice etc.

The invention provides, in an image forming apparatus in which toner carrying tubes are connected at lateral faces thereof, an image forming apparatus of stable operation without clogging of the powder material.

This application claims priority from Japanese Patent Application No. 2003-282815 filed Jul. 30, 2003, which is hereby incorporated by reference herein.

What is claimed is:

1. An image forming apparatus comprising:

image forming means;

a first carrying path for carrying toner discharged from said image forming means toward a recovery portion;

a first carrying member contained in said first carrying path and for carrying the toner toward said recovery portion;

a second carrying path connected to an aperture of said first carrying path for carrying the toner carried from said first carrying path, wherein an angle formed by a toner carrying direction of said second carrying path in a region opposed to said aperture and a gravitationally downward direction is larger than an angle formed by a toner carrying direction of said first carrying member in the region opposed to said aperture and the gravitationally downward direction; and a second carrying member contained in said second carrying path for carrying the toner toward said recovery portion, wherein, at least in the region opposed to said aperture a carrying amount per unit time by said second carrying member is made larger than a carrying amount per unit time by said first carrying member.

2. An image forming apparatus according to claim 1, wherein said second carrying path includes an introducing aperture for introduction from said first carrying path and a discharging aperture for toner discharge toward said recovery portion, and executes an upward carrying in which said discharging aperture is positioned higher than said introducing aperture.

3. An image forming apparatus according to claim 1, wherein a rotation speed of said second carrying member is larger than a rotation speed of said first carrying member.

4. An image forming apparatus according to claim 1, wherein a carrying power, for carrying toner toward said aperture, of said first carrying member in the vicinity of said aperture is smaller than at an upstream side of said aperture.

5. An image forming apparatus according to claim 4, wherein each of said first and second carrying members includes a spiral portion, and a change in the carrying power includes a change in a pitch or a carrying direction of said spiral portion.

6. An image forming apparatus according to claim 1, wherein said aperture is provided in an end portion of said first carrying path, and said first carrying member loses carrying power within a range opposed to said aperture.

7. An image forming apparatus according to claim 1, wherein said first carrying member includes a spiral portion, said first and second carrying paths have carrying directions which substantially perpendicularly intersect with each other at said aperture, and said spiral portion rotates, at the side of said aperture, in a forward direction to the carrying direction of said second carrying path.

8. An image forming apparatus according to claim 1, wherein said second aperture is positioned below a toner introducing portion of said first carrying path in said image forming apparatus, and a toner discharging portion of said second carrying path is positioned above a toner introducing portion of said second carrying path in said image forming apparatus.

9. An image forming apparatus comprising:

image forming means;

a first carrying path for carrying toner discharged from said image forming means toward a recovery portion;

a first aperture provided in said first carrying path;

a first carrying member contained in said first carrying path and for carrying the toner toward said recovery portion, wherein a carrying power, for carrying toner toward said first aperture by said first carrying member, is smaller in the vicinity of said first aperture than in an upstream side of said first aperture;

a second carrying path for carrying the toner carried from said first carrying path;

a second carrying member contained in said second carrying path and for carrying the toner toward said recovery portion; and a second aperture provided in said second carrying path and connected to said first aperture so that the toner in said first carrying path is carried to said second carrying path.

* * * * *

UNITED STATES PATENT AND TRADEMARK OFFICE

CERTIFICATE OF CORRECTION

PATENT NO. : 7,127,207 B2
APPLICATION NO. : 10/900338
DATED : October 24, 2006
INVENTOR(S) : Teruaki Tsurusaki It is certified that error appears in the above-identified patent and that said Letters Patent is hereby corrected as shown below:

COLUMN 1:
Line 15, “apparatus” should read --apparatus,--.
Line 25, “including” should read --includes--.

COLUMN 2:
Line 33, “dusts,” should read --dust,--.
Line 57, “a” should be deleted.

COLUMN 3:
Line 4, “of” should be deleted.

COLUMN 6:
Line 45, ““d”” should read --d--.

COLUMN 7:
Line 7, “surface” should read --surface of--.

COLUMN 9:
Line 4, “execute” should read --executes--.

COLUMN 11:
Line 54, “an” should be deleted.

COLUMN 19:
Line 5, “there” should read --thereby--.

Signed and Sealed this

Thirty-first Day of July, 2007

JON W. DUDAS
*Director of the United States Patent and Trademark Office*